United States Patent [19]

Nagai et al.

[11] 3,960,044

[45] June 1, 1976

[54] KEYBOARD ARRANGEMENT HAVING AFTER-CONTROL SIGNAL DETECTING SENSOR IN ELECTRONIC MUSICAL INSTRUMENT

[75] Inventors: Yohei Nagai; Kiyoshi Kawamura, both of Hamamatsu, Japan

[73] Assignee: Nippon Gakki Seizo Kabushiki Kaisha, Hamamatsu, Japan

[22] Filed: Oct. 17, 1974

[21] Appl. No.: 515,541

[30] Foreign Application Priority Data

| | | |
|---|---|---|
| Nov. 2, 1973 | Japan | 48-126553 |
| Nov. 15, 1973 | Japan | 48-131242 |
| Oct. 18, 1973 | Japan | 48-120990 |
| Oct. 18, 1973 | Japan | 48-120991 |
| Dec. 10, 1973 | Japan | 48-140780 |
| Dec. 10, 1973 | Japan | 48-140781 |
| Dec. 10, 1973 | Japan | 48-140782 |
| Dec. 10, 1973 | Japan | 48-140783 |

[52] U.S. Cl. ..... 84/1.01; 84/DIG. 7; 200/159 B

[51] Int. Cl.[2] ..... G10H 1/00

[58] Field of Search ..... 338/69, 47, 96, 114; 84/1.01, 1.17, 1.12, 1.24, 1.25, DIG. 7, 1.13; 200/159 B

[56] References Cited

UNITED STATES PATENTS

| | | | |
|---|---|---|---|
| 1,847,119 | 3/1932 | Lertes et al. | 84/1.17 X |
| 2,036,691 | 4/1936 | Gourov | 84/1.17 X |
| 2,141,231 | 12/1938 | Trautwein | 84/1.24 X |
| 2,340,213 | 1/1944 | Ellsworth | 84/DIG. 7 X |
| 2,445,660 | 7/1948 | Bruestle | 338/114 |
| 2,848,920 | 8/1958 | Lester | 84/1.17 X |

FOREIGN PATENTS OR APPLICATIONS

| | | | |
|---|---|---|---|
| 1,465,966 | 5/1969 | Germany | 338/114 |

*Primary Examiner*—Ulysses Weldon
*Attorney, Agent, or Firm*—Cushman, Darby & Cushman

[57] ABSTRACT

A keyboard arrangement having an after-control signal detecting sensor means connected to electric circuitry to use the signal generated by this sensor means as an after-control signal for controlling various musical effects. This sensor means comprises a conductive flexible first electrode, a conductive second electrode, and a conductive elastic member, such as a conductive rubber, interposed between the first and second electrodes and adhered thereto, the conductive elastic member varying its resistance according to the degree by which it is compressed and deformed. With this arrangement, the resistance of the conductive elastic member will vary as it is compressed and/or deformed by playing keys in proportion to the positions of the depressed keys. This variation of resistance is employed so as to after-control the tone coloring, tone volume, vibrato, and other musical effects.

7 Claims, 42 Drawing Figures

KEYBOARD ARRANGEMENT HAVING AFTER-CONTROL SIGNAL DETECTING SENSOR IN ELECTRONIC MUSICAL INSTRUMENT

BACKGROUND OF THE INVENTION

1. Field of the invention

This invention relates generally to an electronic musical instrument, and more particularly to an improved keyboard arrangement capable of obtaining after-control of various musical effects for an electronic musical instrument.

2. Description of the prior art

In the electronic musical instrument of the prior art, the "after-control" of tone color, tone volume and, for example, vibrato effect were carried out by independent control devices assigned exclusively for these purposes, which were provided apart from the keyboard arrangement of the instrument. Therefore, the overall structure of the electronic musical arrangement tended to become quite complicated and accordingly expensive. Besides, those who had played a piano but had no experience in playing an electronic musical instrument have found this instrument quite difficult to handle. Therefore, there has been a demand for an electronic musical instrument which can produce various controlled effects in a much simpler manner without requiring special cost.

SUMMARY OF THE INVENTION

This invention intends to replace the conventional complicated variable resistance element used in after-control device of an electronic musical instrument by a simplified keyboard arrangement.

An object of this invention is, therefore, to provide an improved, unique keyboard arrangement for an after-control device of an electronic musical instrument, which is capable of producing various musical effects with a simplified structure.

Another object of the present invention is to provide a keyboard arrangement of the type described for performing after-control of tone color, tone volume, vibrato, and other musical effects by a mere vertical and/or horizontal movements of keys.

A further object of the present invention is to provide a keyboard arrangement of the type described having a plurality of key-associated sensors each comprising a conductive elastic member to be compressed by a vertical and/or horizontal key movement to vary the impedance to give off a control signal corresponding to the degree of such movement of the key.

A still further object of the present invention is to provide a keyboard arrangement wherein an electric signal derived from the impedance variation of the conductive elastic member by the selective depression of keys is employed as an after-control signal.

BRIEF DESCRIPTION OF THE DRAWINGS

FIGS. 6A and 6B are schematic equivalent electric circuit diagrams of the after-control signal detecting sensor means shown in FIGS. 5A and 5B, respectively, according to the invention, in which FIG. 6A shows the state of resistance of the elastic conductive member which is substantially infinite where no key is depressed.

Throughout the specification and the drawings, like parts are indicated by like reference numerals and symbols for the simplicity of explanation.

DESCRIPTION OF THE PREFERRED EMBODIMENTS

Figure 1:
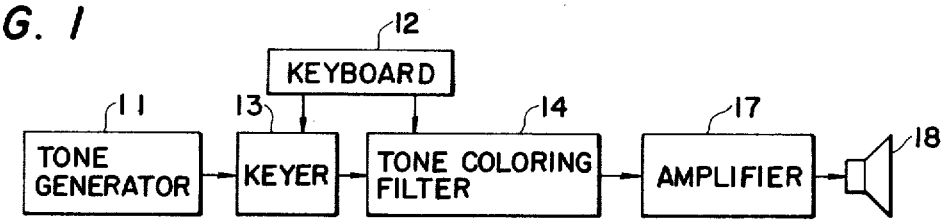
FIG. 1 is a block diagram of an example of an electronic musical instrument having a tone coloring filter according to this invention to show the general system of the instrument.

FIG. 1 shows a block diagram of an example of the general arrangement of an electronic musical instrument. This electronic musical instrument, in general, is of the type having a tone generator circuit 11 for generating a tone signal which is fed to a keyer circuit 13 which is operated and controlled in response to the selective depression of a keyboard 12 from which a tone signal corresponding to an operated key is derived. The tone signal is then introduced into, for example, a tone coloring filter circuit 14 in which the tone signal is converted to a musical tone signal. This musical tone signal is supplied via an amplifier 17 to a loud speaker 18 through which the signal is converted to an audible musical sound.

Figure 2:
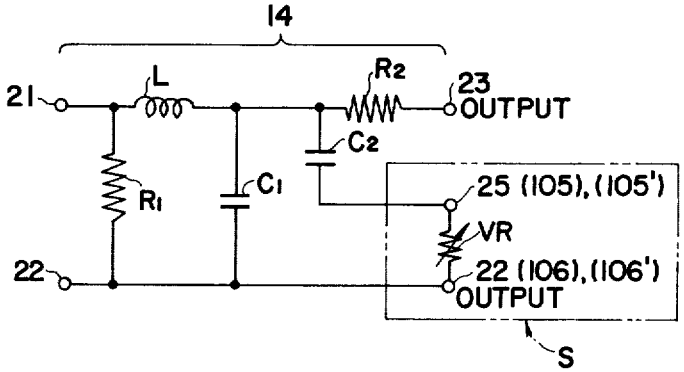
FIG. 2 is a schematic electric circuit diagram of a unique arrangement of the circuit of the tone coloring filter to be used in the electronic musical instrument of FIG. 1 embodying the invention.

FIG. 2 shows a schematic electric circuit diagram of an example of the tone coloring filter circuit 14 to which this invention is applicable. In the drawing, a first resistor $R_1$ is connected across an input terminal 21 and a common terminal 22. Between the input terminal and an output terminal 23 are provided a series circuit of a coil L and a second resistor $R_2$. A first capacitor $C_1$ is connected across the junction of said series circuit and the common terminal 22. In addition, the junction is introduced via a second capacitor $C_2$ to a specifically arranged variable impedance or resistor VR, i.e., an after-control signal detecting sensor means according to the present invention, as will be explained later in detail in connection with FIG. 5A through FIG. 30B, but in this FIG. 2 the resistor VR is shown just for mentioning the principle.

Figure 3:
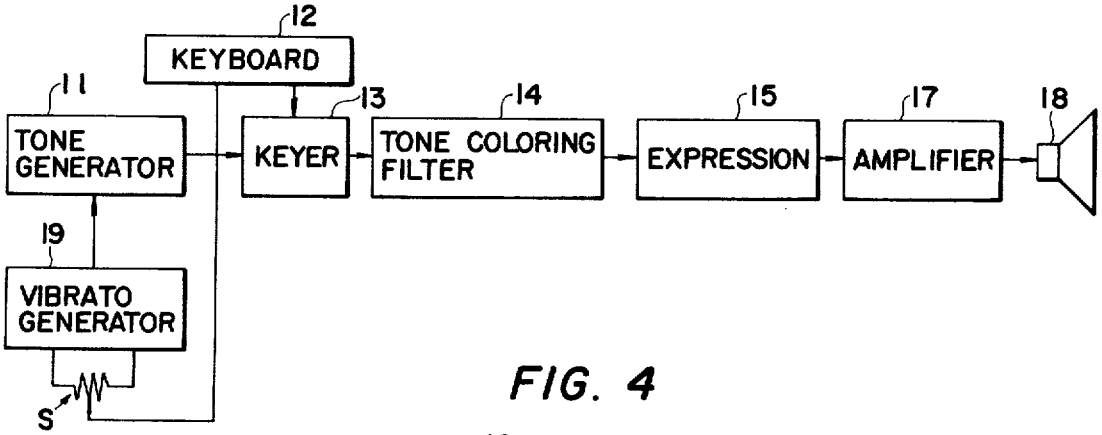
FIG. 3 is a block diagram of a further example of an electronic musical instrument having a vibrato generator associated with the tone generator and operatively associated with the keys of the keyboard to show the general arrangement of the present invention.

FIG. 3 shows a block diagram of another example of a whole system of an electronic musical instrument to which the present invention is applicable. This electronic musical instrument, in general, is of the type having a tone generator circuit 11, a keyboard arrangement 12, a keyer circuit 13, a tone coloring filter circuit 14, an expression circuit 15, an amplifier circuit 17, a loud-speaker 18, and a vibrato generator circuit 19 which are all of the known parts in the art except for the keyboard arrangement according to the present invention, and which are connected in the order as shown in FIG. 3.

Referring to block diagram of FIG. 3, it should be understood that the tone keyer circuit 13 and the vibrato generator 19 are operated and controlled in response to the selective depression of the keyboard arrangement 12, and thus a tone signal corresponding to an operated key is derived.

Figure 4:
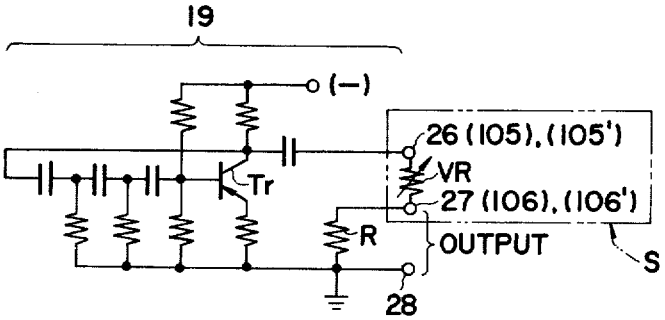
FIG. 4 is a schematic electric circuit diagram of an example to the vibrato generator circuit to be used in the electronic musical instrument of FIG. 3 embodying the invention.

FIG. 4 shows a schematic electric circuit diagram of the vibrato generator circuit 19 to be used in the electronic musical instrument of FIG. 3.

The vibrato generator circuit 19 is of the type having a transistor and capacitors, a resistor R for deriving the output signal, and a specifically arranged variable impedance or resistor VR, i.e., an after-control signal detecting sensor means according to the invention, which will be explained in detail later in connection with FIG. 5A through FIG. 30B, but in this FIG. 4 this variable resistor VR is shown just for mentioning the principle.

Above are the only examples of the musical effect producing circuits to which the present invention is applicable. The keyboard arrangement, especially the after-control signal detecting sensor means, of the present invention may be used for any other musical effect producing circuits to obtain an after-control effect therefrom.

To effect an "after-control", for example, tone coloring control, tone volume control, vibrato effect control and the like, the conventional electronic musical instrument has been provided with a special, complicated control means arranged separately from the keyboard. In good contrast to this known art, according to this invention, such controls are carried out simply by the manipulation or movement of the keys on the keyboard arrangement. Beneath the keys is disposed a detecting sensor means which is arranged to be operative in unique fashion that when its conductive elastic member is deformed by the depression of any key or keys, its impedance is varied in accordance with the forced deformation thereof. The impedance change produced locally in said conductive elastic member in accordance with the depression of the intended key is picked off as an electric signal to be used as the aftercontrol signal.

Figure 5A:
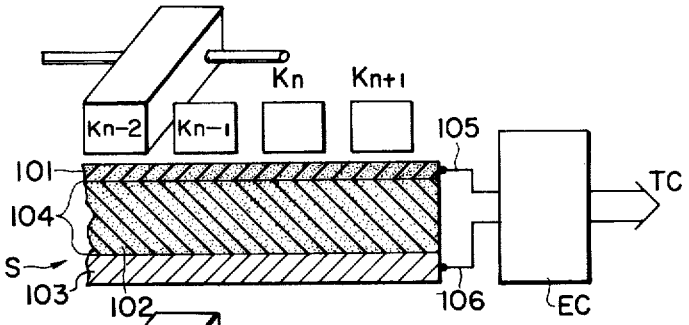
FIGS. 5A and 5B are somewhat diagrammatic fragmentary sectional views, partly shown in block form, of an example of the key-associated after-control signal detecting sensor means according to the present invention which includes a first flexible conductive electrode, a second rigid conductive electrode and an elastic conductive member of a variable impedance interposed between these two electrodes.
Figure 5B:
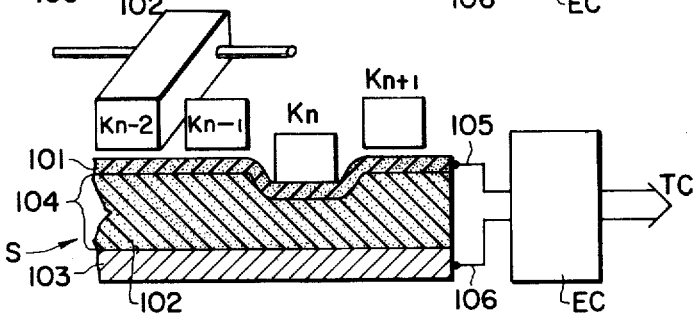

Referring now to the drawings, FIG. 5A and FIG. 5B are somewhat diagrammatic fragmentary sectional views of the keyboard arrangement in accordance with the present invention which is combined with a musical effect-producing electric circuit, for example, a tone coloring filter circuit or a vibrato signal generator circuit. FIG. 5A is a somewhat diagrammatic fragmentary sectional view of a part of the combination keyboard arrangement when keys are not in the depressed state; FIG. 5B is a similar fragmentary sectional view when a key $K_n$ is depressed to such an extent as has caused a deformation of the key-associated detecting sensor means which will be described in detail later. In FIGS. 5A and 5B key $K_{n-2}$ is shown schematically as pivotably mounted. It will be understood that the remainder of the keys are similarly mounted but are simply shown as blocks for clarity of illustration.

The after-control signal detecting sensor means generally indicated by S comprises (a) a conductive terminal (electrode) member 101 which is made of, for example, a flexible and elastic conductive. rubber such as butadiene rubber intermixed with silver dust which has a relatively low resistivity of, for example, the order of $10^{-2}\Omega\cdot$cm; (b) a conductive elastic and flexible member 102 which is made of a foamed conductive rubber such as foamed butadiene rubber intermixed with conductive particles, for example, carbon black particles (40~60 wt.%) and has the characteristic that its electrical resistance value is varied in accordance with the degree of its deformation when compressed by an external force; and (c) a conductive rigid base member 103 which is made of, for example, a conductive metal. The conductive elastic member 102 exhibits a resistance of the order of 50~200kΩ when compressed. The conductive terminal member 101 is firmly bonded, by a conductive bonding or adhesive agent 104, to the conductive elastic member 102 which, in turn, is firmly bonded, by a similar conductive bonding or adhesive agent 104, to the conductive rigid base member 103 so that these members are firmly secured to each other as an integral body. The conductive terminal member 101 is expected only to serve as an electrode and to function to convey the pressure or force applied thereto to the conductive flexible and elastic member 102 and, accordingly the member 101 may be made much thinner than the member 102.

This sensor means S extends for such a length in the transverse direction of the array of keys as is sufficient to correspond to all of these keys and is positioned at a predetermined space from the keys.

The conductive terminal member 101 and the metal base member 103 are provided with lead wires 105 and 106, respectively, which extend from one end of these two members on the same side. These lead wires 105 and 106 are connected at their other ends to the input terminals of a subsequent stage electric circuitry EC which produces an after-control signal TC in accordance with the impedance variation generated in said after-control signal detecting sensor means S.

Figure 6A:
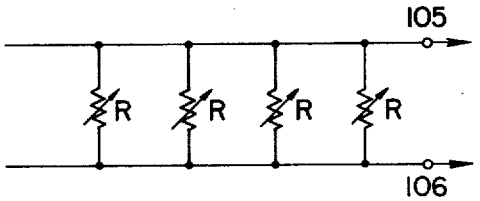
Figure 6B:
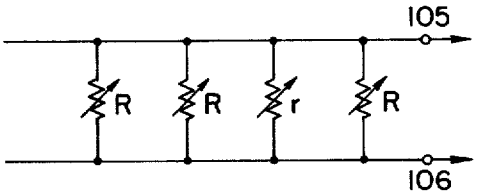

The operation of the keyboard arrangement including the aforesaid after-control signal detecting sensor means S shown in FIGS. 5A and 5B will be described by referring to FIGS. 6A and 6B. FIG. 6A is an equivalent circuit diagram of the after-control signal detecting sensor means S of FIG. 5A when no key is depressed so that the keys are spaced from the conductive elastic terminal member 101. FIG. 6B is a similar equivalent circuit diagram of this sensor means S corresponding to the state of keys of FIG. 5B in which a key $K_n$ is depressed to such an extent as has caused a compression and deformation of the conductive elastic terminal member 101 and of the conductive elastic terminal member 101 and of the conductive elastic member 102 as shown in FIG. 5B. As will be noted in FIG. 6A when taken jointly with FIG. 5A, the resistance possessed by the conductive elastic member 102 interposed between the conductive elastic terminal member which will hereunder be called the first electrode member 101 and the conductive base member which will hereunder be called the second electrode member 103 may be regarded as a pure resistance R for the respective keys positioned correspondingly thereabove, in the mode of the instrument when no key is depressed and when accordingly the sensor means S has undergone no deformation.

Let us now assume that a desired key $K_n$ of the row of keys is depressed until it is brought into contact with the first electrode member 101 but to the extent not causing a depression of the corresponding portion of this member 101 and accordingly the compression-deformation of the corresponding portion of the conductive elastic member 102 either. A further depression of this key $K_n$ produces a depression and compression-deformation of said corresponding portions of these two members 101 and 102 of the sensor means S in accordance with the magnitude of the depression force of the key.

Whereupon, the conductive particles or metal dust which are located in the compressed region of the conductive member 102 are caused to gather there densely, and this particular region of the conductive member 102 will exhibit a resistance value r which is much smaller than that resistance value R of the same portion of this member which has till then been exhibited when this member was not compressed by the key, i.e. a resistance $R >> r$.

The resistance value of this conductive member 102 continues to exhibit such a low resistance value so long as this member 102 is kept compressed. Accordingly, it will be apparent that the resulting change in the impedance of the sensor means S can be used as an after-control signal. This signal detected from the sensor S can be used also, for example, simply for the production of a controlled sustain effect.

The first electrode member 101 is rich in elasticity and flexibility, and also the conductive elastic member 102 made with a material such as foamed conductive rubber is also elastic and flexible. Therefore, these two members function to absorb the impact of the key which is produced at the time a key is depressed and they also present the effect of a buffer means to a sufficient degree. It should be understood that the first electrode member 101 which has been described to be made with a conductive rubber may be replaced by, for example, a different type of conductive elastic or flexible member such as a thin metal plate which is ordinarily used as a spring.

Figure 7A:
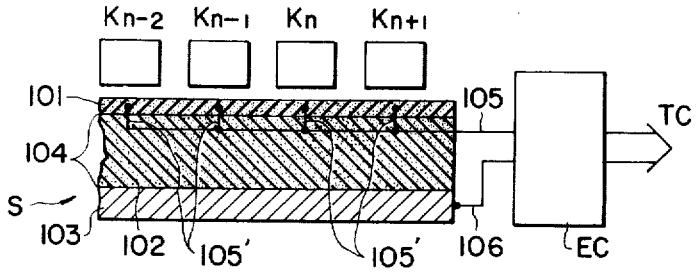
FIGS. 7A and 7B are somewhat diagrammatic fragmentary sectional views, partly shown in block form, of another example of the key-associated aftercontrol signal detecting sensor means according to the present invention in which a first flexible conductive electrode includes a plurality of branched leads positioned in correspondence to the positions of the keys according to the present invention.
Figure 7B:
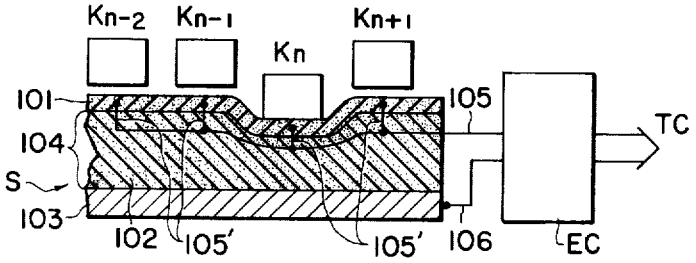

FIGS. 7A and 7B show a modified example of the present invention. FIG. 7A is an illustration of the state of the sensor means S when a key or keys are not depressed. FIG. 7B shows a state of same in which a key $K_n$ is depressed deeply. The sensor means of this modified example which is indicated similarly by S comprises a flexible or elastic conductive rubber member or a first electrode member 101, a variable impedance member 102 which is made with a material, such as a somewhat hard but flexible and elastic foamed conductive rubber, which can exhibit variations in impedance whenever its configuration is deformed due to its being compressed, and a rigid metal base member or a second terminal (electrode) member 103. The first electrode member 101 and the second electrode member 103 are secured firmly to the variable impedance member 102, respectively, at the opposite sides of this member 102 with a conductive adhesive bonding agent 104.

Since the first terminal (electrode) member 101 is made of a conductive rubber, the resistance value thereof varies depending on the position at which this member is depressed by a key as is so with the variable impedance member 102. In order to compensate for such resistance variations of this first electrode member 101 due to the positions depressed by the keys, there are provided, according to this modified example, a plurality of lead wires 105' branched from a lead wire 105 and these branched lead wires 105' are connected to the first electrode member 101 at such positions as are corresponding to the positions of the respective keys of the keyboard.

These positions of the branched lead wires 105' should, therefore, be understood to correspond to the respective different tone pitches of the keys of the keyboard.

By this arrangement, it is possible to derive a signal in common from the lead 105 in such a way that this signal is completely irrelevant to the resistance inherent to the first electrode member 101 itself.

The impedance variations of the variable impedance member 102 are fed to an electric circuitry EC through the leads 105 and 106 which are connected to the first and the second electrodes 101 and 103, respectively.

The after-control signal TC corresponding to the state of compression of the variable impedance member 102 is derived from the electric circuitry EC.

Figure 8A:
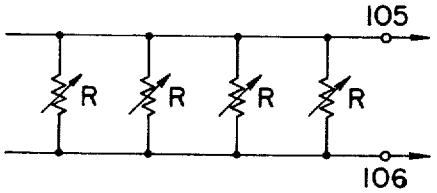
FIGS. 8A and 8B are schematic equivalent electric circuit diagrams of the after-control signal detecting sensor means shown in FIGS. 7A and 7B, respectively, according to the invention, to show the variation of resistance between the two electrodes from the non-depression to the depression state of a key.
Figure 8B:
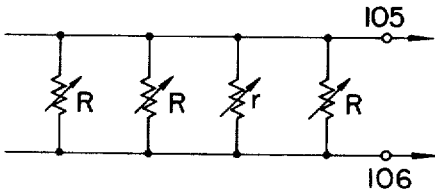

FIGS. 8A and 8B show the operation of the key arrangement of the electronic musical instrument according to this example. FIG. 8A is an equivalent circuit diagram of the after-control signal detecting sensor means S when a key or keys are not in the depressed state shown in FIG. 7A.

FIG. 8B is a similar equivalent circuit diagram of the detecting sensor means S when a key $K_n$ is in the deeply depressed position shown in FIG. 7B.

Now, let us assume that the impedance of each of the respective portions of the conductive variable impedance member 102 corresponding to the respective keys $K_{n-2} \ldots K_{n+1}$ is a pure resistance R. Then, the equivalent circuit when said member 102 is not depressed by a key can be expressed by a paralled circuit of a plurality of resistances R's.

When any desired key $K_n$ is depressed, that portion of the elastic detecting sensor means S corresponding to this key is compressed accordingly. From FIG. 7B it will be readily understood that as this variable impedance member 102 is locally compressed, the conductive particles contained in the compressed region of this member 102 which is made of a foamed conductive rubber are caused to gather densely, with the result that this region of the conductive member 102 will exhibit a resistance value *r* which is much smaller than that resistance value R of the same member which is exhibited when this member is not compressed by the key, i.e. a resistance $R >> r$.

The resistance value of this conductive member 102 continues to exhibit a low value so long as this member 102 is kept compressed. Accordingly, it will be apparent that the resulting change in impedance of the sensor means S can be derived as an electric signal for being used as an after-control signal. The after-control operation, therefore, can be carried out simply by the more manipulation of the keys on the keyboard.

Since the first electrode (terminal) member 101 made of a conductive rubber and the variable impedance member 102 made of a foamed conductive rubber both have good flexibility and elasticity, it is possible to detect accurately the degree of depression and compression of these members caused by a key operation. Moreover, these members serve as shock absorbers to buffer the impact of keys. The rigid metal base member 103 is prepared so as not to be bended by the key depression force.

Figure 9A:
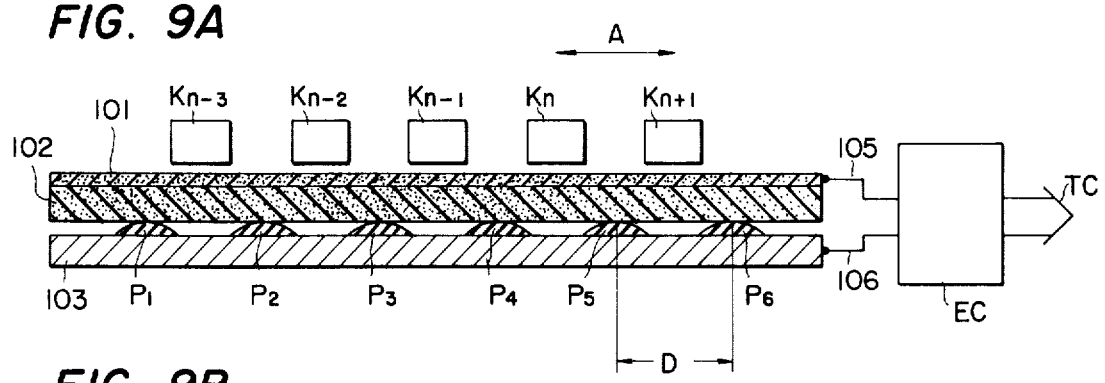
FIG. 9A is a somewhat diagrammatic fragmentary sectional view of another example of the aftercontrol signal detecting sensor means according to the present invention in which the second rigid conductive electrode is provided with a plurality of insulating projections arranged at alternate staggering positions relative to the positions of the keys.

FIG. 9A is an illustration of a further embodiment showing a front view of the keyboard arrangement when no key is depressed. In this example, ther there are shown only five Keys $K_{n-3}$, $K_{n-2}$, $K_{n-1}$ and $K_{n+1}$ for the sake of simplicity.

Below these keys is provided a sheet-like layer 101 of a flexible and elastic terminal (electrode) member having a resistivity of the order of $10^{-2}$ Ω·cm. Between these keys $K_{n-3} \sim K_{n+1}$ and said terminal member 101 is set a predetermined space interval. Also, beneath said terminal member 101 is abuttingly and integrally provided a sheet-like layer of, for example, a foamed conductive resilient flexible member 102 producing a resistance in the range of 50 ~ 200 kΩ when compressed. Usually, the terminal member 101 is firmly bonded to the conductive flexible resilient member 102 with a conductive bonding agent.

Below the aforesaid conductive member 102 is provided, at an appropriate interval therefrom, a conductive rigid metal base 103. This metal base 103 is provided, in the transverse direction A of the disposition of the keys $K_{n-3}, \ldots, K_{n+1}$ and at predetermined lateral even intervals, with a plurality of projections $P_1$, $P_2$, $P_3$, $P_4$, $P_5$ and $P_6$ which are made of a rigid insulating material. In this example, these projections are arranged in such a fashion that the keys and the projections are disposed in alternate, staggering relationship to each other. Thus, due to the provision of these insulating projections $P_1 \sim P_6$, the current flow between the conductive resilient member 102 and the metal base member 103 is normally insulated. Accordingly, the resistance value between the lead wire 105 extending from the terminal member 101 and the lead wire 106 extending from the metal base 103 is normally rendered substantially infinite, thereby no current flows therebetween.

Figure 9B:
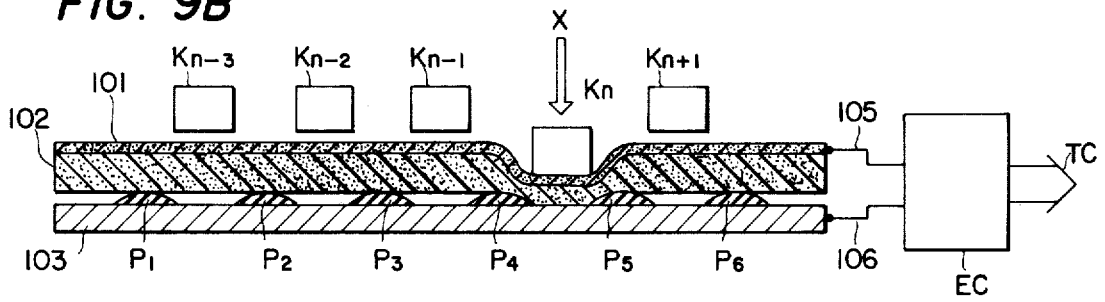
FIG. 9B is a somewhat diagrammatic fragmentary sectional view of the after-control signal detecting sensor means of FIG. 8A to show its compressed state when a key is depressed.

Let us now assume that a key $K_n$ is depressed deeply in a manner as shown by the arrow X in FIG. 9B. Whereupon, a keyer switch not shown is actuated. Along therewith, the terminal member 101 and the conductive resilient member 102 are flexed by the depressed key $K_n$ in the regions surrounding this key, and these members are pressed against the hard metal base member 103 which is positioned therebelow. Thus, conductive particles contained in the conductive member 102 are caused to gather densely in this region thereof, and accordingly, current flows at a certain resistance between the conductive member 102 and the metal base member 103.

Figure 10:
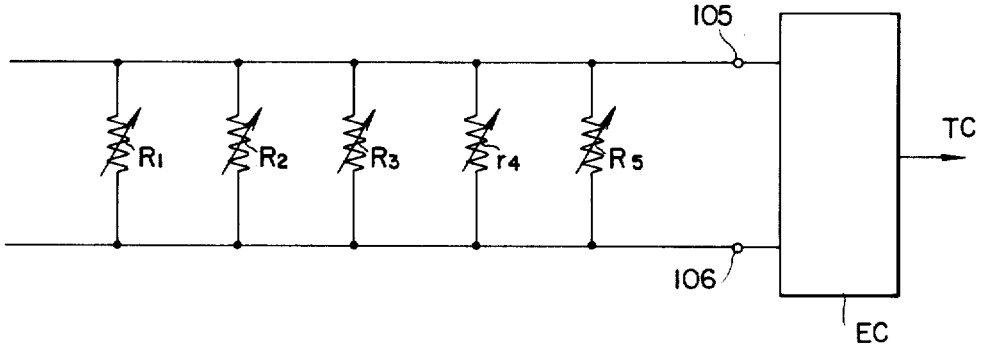
FIG. 10 is a schematic equivalent electric circuit diagram connected to a subsequent electric circuitry shown in block form of the after-control signal detecting sensor means of FIG. 9B to show the almost infinite resistance between the two electrodes when no key is depressed.

This relation is expressed in an equivalent circuit diagram in FIG. 10. As compared with the resistances $R_1$, $R_2$, $R_3$ and $R_5$ which are formed between the conductive resilient member 102 and the metal base member 103 in those portions corresponding to the non-depressed keys $K_{n-3}$, $K_{n-2}$, $K_{n-1}$ and $K_{n+1}$ and which are thus substantially infinite in resistance value, the resistance $r_4$ which is formed between the conductive member 102 and the metal base 103 is much smaller so that there flows a current therebetween. Besides, depending on the degree of depression force of the key $K_n$, there develops variations in the area of contact between the conductive member 102 and the metal base member 103, so that said resistance value $r_4$ is rendered variable. Because of this fact, it is possible to use the output signal TC derived from the electric circuitry EC connected to the lead wires 105 and 106 extending from the first electrode member 103, respectively, for the after-controlling such as vibrato control, tone volume control, tone coloring control or the like, and these after-controls can be effected simply by the operation of keys.

In this example also, the first electrode member 101 and the conductive member 102 are elastic and flexible, so that they conveniently fulfill the role of mechanical buffer means against the impact of keys applied to the projections and the metal base member 103.

Figure 11:
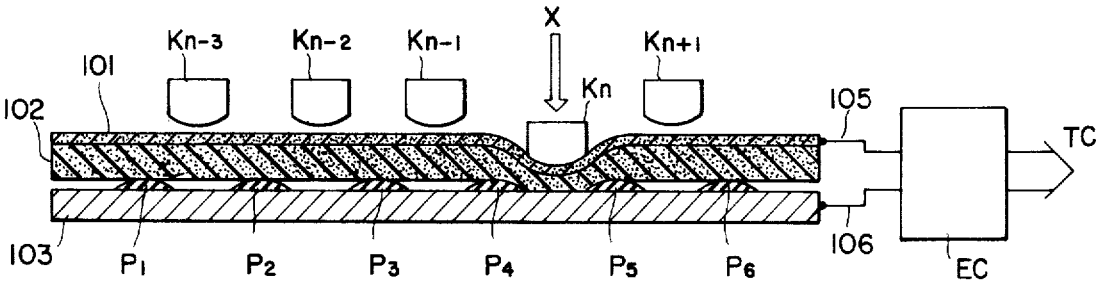
FIG. 11 is a somewhat diagrammatic fragmentary sectional view of a slightly modified example of the after-control signal detecting sensor means of FIG. 9B, in which the keys are of the bottom convex shape.

FIG. 11 shows a slight modification of the keyboard arrangement of FIGS. 9A and 9B. In this modification, the respective keys are given a bottomconvexed configuration which will produce smoother depression and deformation of the first electrode member and the conductive resilient member.

Figure 12:
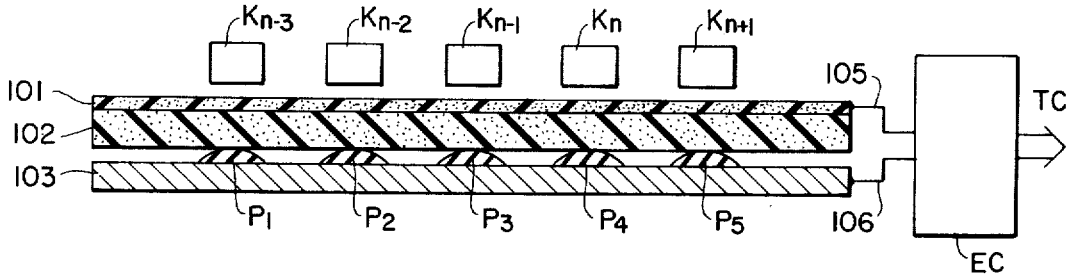
FIG. 12 is a somewhat diagrammatic fragmentary sectional view of a modified example of the aftercontrol signal detecting sensor means of FIG. 9A, in which the rigid insulating projections are positioned just below the corresponding keys.

In the example of FIGS. 9A and 9B, the insulating projections $P_1 \sim P_6$ are shown to be arranged in alternate staggering fashion relative to the keys, to show an example of the manner of their arrangement. However, these projections may be positioned just below the keys as shown in FIG. 12. In such an arrangement, the value of resistance $r_4$ will be determined by the area of contact between the metal base member 103 and the conductive resilient member 102 in the latter's regions extending on both sides of the projection $P_4$ when the key $K_n$ is depressed deeply. Therefore, this example of arrangement will be advantageous in case actuation or behavior of the instrument with a key depression force above a certain value is required in particular.

Figure 13:
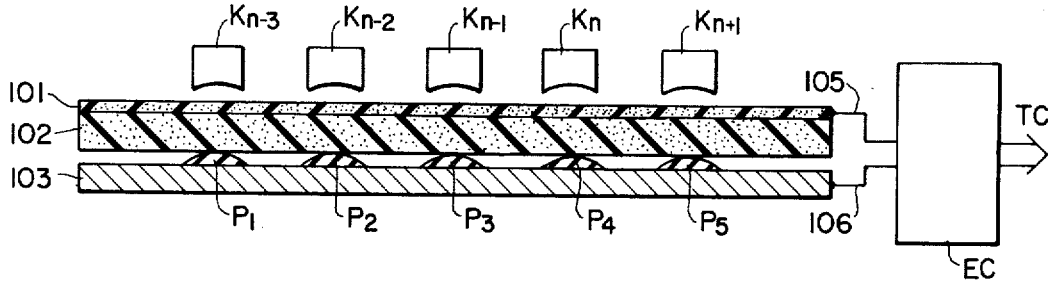
FIG. 13 is a somewhat diagrammatic fragmentary sectional view of a further modified example of the after-control signal detecting sensor means of FIG. 12, in which the keys are of the bottom concave configuration.

FIG. 13 shows a slight modification of the keyboard arrangement of FIG. 12. In this modification, the respective keys are given a bottom-concaved configuration so that those portions of the conductive resilient member 102 extending on both sides of each projection P may easily be brought into contact with the metal base member 103.

Figure 14A:
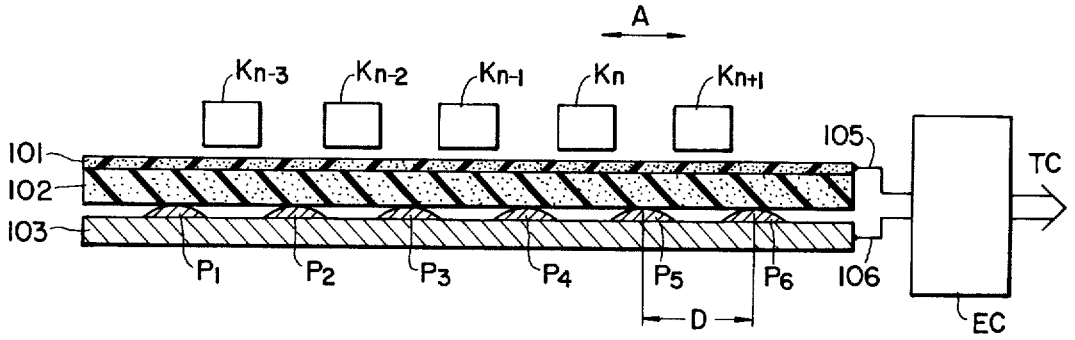
FIG. 14A is a somewhat diagrammatic fragmentary sectional view of a still further modified example of the after-control signal detecting sensor means according to the present invention, in which the second rigid conductive electrode is provided with a plurality of conductive projections arranged in alternate staggering fashion relative to the keys.

FIG. 14A is a front view of a further example of the keyboard arrangement according to the present invention when no key is depressed.

In this example, only five keys $K_{n-3} \sim K_{n+1}$ are mentioned for the simplicity of explanation. These keys are arranged in the directions of the arrows A. Below these keys are provided a sheet-like layer 101 serving as a flexible first terminal or electrode member at a predetermined clearance therebetween. Beneath this first electrode member 101 is provided integrally therewith a sheet-like conductive, foamed flexible and elastic member 102 having a resistance of the order of 50~200 kΩ which is exhibited when this member 102 is compressed. In general, these two members are firmly bonded together by a conductive bonding agent as in the preceding examples.

Below the conductive elastic member 102 is disposed a rigid metal base member 103 which, in turn, is provided with a plurality of projections $P_1$, $P_2$, $P_3$, $P_4$, $P_5$ and $P_6$ which are made of a conductive rigid material and which are arranged at an equal distance D between two adjacent projections as shown in FIG. 14A. These projections are arranged in alternate, staggering fashion relative to the keys. These projections may be molded integrally with the metal base member 103 or alternatively they may be made separately from the base member for being united together later by known process.

In the state of the arrangement of the keyboard in which no key is depressed as shown in FIG. 14A, the contact area between the elastic conductive member 102 and the conductive rigid projections is very small. Accordingly, the resistance between the terminal 105 of the first electrode member 101 and the terminal 106 of the second electrode member 103 is very great, and thereby no current flows therebetween.

Figure 14B:
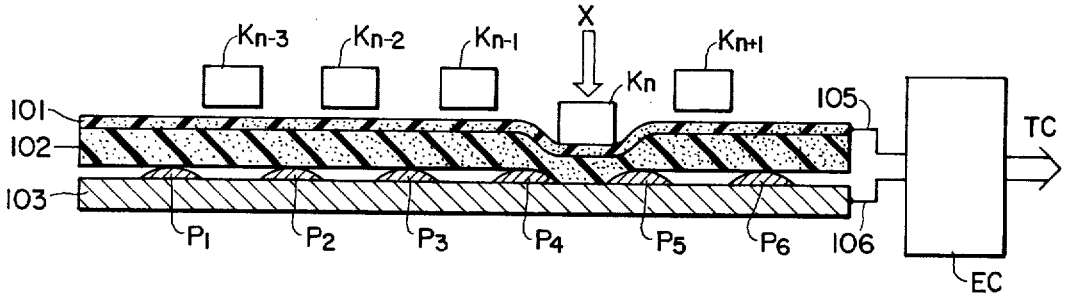
FIG. 14B is a somewhat diagrammatic fragmentary sectional view of the sensor means of FIG. 13 showing the state in which the first elastic conductive electrode and the elastic conductive member are deformed and compressed by the depression of a key.

Let us now suppose that a key $K_n$ is depressed in the direction of the arrow X in FIG. 14B. Whereupon, a key switch not shown in actuated and along therewith the conductive elastic member 102 which is pressed downwardly by this key $K_n$ in caused to flex and to be pressed against the metal base member 103. As a result, these latter two members will have an increased area of contact at such regions around the projection. Moreover, the conductive particles of the conductive elastic member 102 will gather densely in these regions. Thus, there will flow a current at a certain resistance between the conductive elastic member 102 and the metal base member 103.

Figure 15:
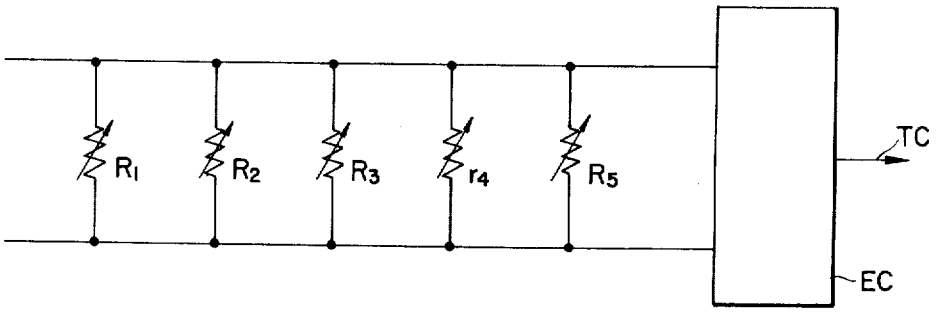
FIG. 15 is a schematic equivalent electric circuit diagram connected to a subsequent electric circuitry shown in block form of the after-control signal detecting sensor means of FIG. 14A to show the almost infinite resistance between the two electrodes when no key is depressed.

This relation is expressed in an equivalent circuit diagram shown in FIG. 15. Based on the reasons similar to those discussed with respect to the preceding examples, the resistance value $r_4$ is very small at the region depressed by the key $K_n$ as compared with the remaining regions where the keys are not depressed. In also the same way as has been stated regarding the preceding examples, this resistance value is rendered variable depending on the magnitude of the depression force of the key. Thus, it is possible to effect after-control operations by a mere operation of keys utilizing the output signal TC derived from the electric circuitry connected to the lead wires 105 and 106.

Figure 16:
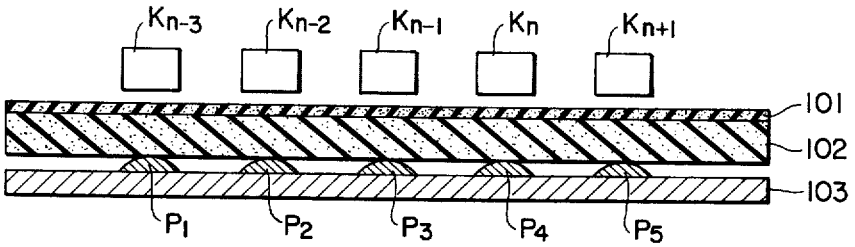
FIG. 16 is a somewhat diagrammatic fragmentary sectional view of a slightly modified example of the after-control signal detecting sensor means of FIG. 14A showing that the conductive projections are arranged just below the corresponding keys.

FIG. 16 shows a slightly modified example of arrangement of the conductive projections relative to the keys. In this example, the projections are disposed just below the corresponding keys, respectively.

Figure 17:
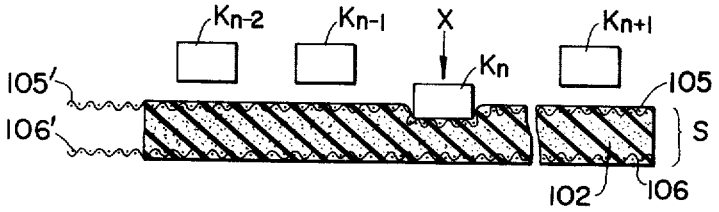
FIG. 17 is a somewhat diagrammatic fragmentary sectional view of a further example of key-associated after-control signal detecting sensor means according to the present invention when a key is depressed, in which the elastic conductive member has a pair of net-shaped resilient and tough electrode members embedded beneath the opposite surfaces of said elastic conductive member to replace the first and the second electrodes shown in FIG. 5A to FIG. 16.

FIG. 17 is a further modified example of the after-control signal sensor means according to the present invention.

Referring to this Figure, only four of keys, $K_{n-2}$, $K_{n-1}$, $K_n$ and $K_{n+1}$, are shown for the simplicity of explanation. At a predetermined distance below these keys is provided an after-control signal detecting sensor means S. This sensor means S comprises a plat-like conductive elastic member 102 extending in the transverse direction of the keys and having a length sufficient for corresponding to all of the keys. A pair of net-like first and second output electrode members 105 and 106 are embedded in this conductive elastic member 102, one 105 at the upper surface portion and the other 106 at the lower surface portion of the conductive elastic member 102 so that these two electrode members face each other.

The conductive elastic member 102 is made with a foamed conductive rubber having a resistance in the range of 50 ~ 200 kΩ when this member is compressed by a key. The electrode members 105 and 106 may be made with any tough, conductive material such as woven tin-plated copper wires. These electrode members are, for example, embedded in the conductive elastic member 102 integrally therewith at the time the latter is molded. By doing so, the electrode members 105 and 106 will not come off when the conductive elastic member 102 is locally deformed due to compression by a key, but instead they are capable of undergoing deformation in a flexible manner in accordance with the compression-deformation of the conductive elastic member 102.

One longitudinal end of each of the electrode members 105 and 106 extends beyond the corresponding end of the conductive elastic member 102, to the left side in FIG. 17, to provide output terminals 105' and 106' of after-control signals.

Needless to say, the conductive elastic member 102 is supported at its bottom by an insulating fixed plate not shown which extends in the transverse direction of the keys. This fixed plate is intended to produce, in the conductive elastic member 102, a force to cope with the pressure applied to this member 102 when a key is pressed strongly vertically onto this member or when this key is moved laterally.

In the aforesaid arrangement, when a key $K_n$ is depressed, a separately provided keying switch not shown is closed, causing a sound having a pitch corresponding to the depressed $K_n$ to be generated.

When the key $K_n$ is depressed further from the aforesaid state as shown by the arrow X, that portion of the conductive elastic member 102 located just below this key is compressed. At such time, the resistance of this compressed portion of the conductive elastic member 102 will become small, and at the same time the distance between the two electrode members 105 and 106 will also become small. Accordingly, the total resistance value between these two electrode members 105 and 106 will undergo substantial variations successively depending on the amount of depression of the key $K_n$ or, in other words, depending on the magnitude of the depression force applied to this key.

Figure 19:
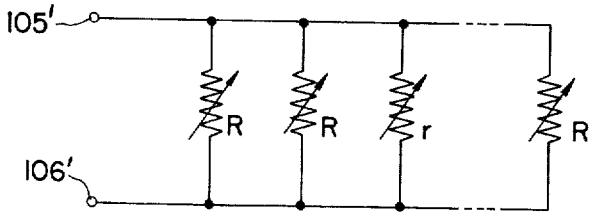
FIG. 19 is a schematic equivalent electric circuit diagram of the after-control signal detecting sensor means of FIG. 17 to show the variation in resistance between the two electrode members when a key is depressed.

Such variations will be obtained for the respective key depressing operations. Therefore, the equivalent circuit diagram of this sensor means S will be expressed in terms of circuit arrangement as shown in FIG. 19 which comprises a plurality of variable resistors R corresponding to keys, arranged in parallel between the output terminals 105' and 106'. From this circuit arrangement diagram, it will be understood that varying synthesized resistances will be derived at the terminals 105' and 106' depending on the amount of depression of keys. By the adoption of this example, it is possible to expect durable, stable electric connection arrangement between the conductive elastic member 102 and the two electrode members 105 and 106.

According to the experiment conducted by the inventors, the lower electrode member 106 made of a rigid metal plate and bonded to the conductive elastic member 102 was used. However, with a sensor means S having such an arrangement, there was noted a difference in electric potential for each difference in distance from both output terminals 105' and 106' up to the positions of the respective keys, causing the development of the inconvenience that the aftercontrol signal value derived from these output terminals differ for each key. This is considered to be explained by the fact that the layer of the conductive bonding agent extends between the metal plate and the conductive elastic member 102 longitudinally thereof. Moreover, it is difficult to firmly bond the nonflexible metal plate to the flexible, deformable conductive member 102 from the viewpoint of making physical connection. Accordingly, such an arrangement will unfailingly result in deterioration in mechanical strength and in the strength of electrical connection of the arrangement as time passes. Such inconveniences of this arrangement can be avoided by the adoption of the example shown in FIGS. 17 and 18. In particular, it has been confirmed from experiment that, in case the conductive elastic member 102 is made with a foamed rubber, an outstandingly good effect is obtained.

According to this example, the sensor means S as a whole can be provided in a very simple plate-like configuration. Furthermore, this sensor means S has another advantage that it can have as simple a structure as that of a stopper and can fulfill the role of this stopper which is provided in almost all kinds of keyboard musical instruments.

The sensor means S has been shown in this example as one which generates an after-control signal for a plurality of keys. However, a sensor means S arranged so that it will generate one after-control signal for one key individually falls within this example. In such a case, the lower electrode member 106 is divided into segments so as to correspond to the respective keys, and an after-control signal is derived from each of these divided sections.

Description of this example has been made with respect to the conductive elastic member 102 which is made with a foamed conductive rubber. However, it is needless to say that any such member made of porous material or a conductive elastic member which will vary in its resistance value whenever it is deformed by the application of an external force can be used also.

Figure 20:
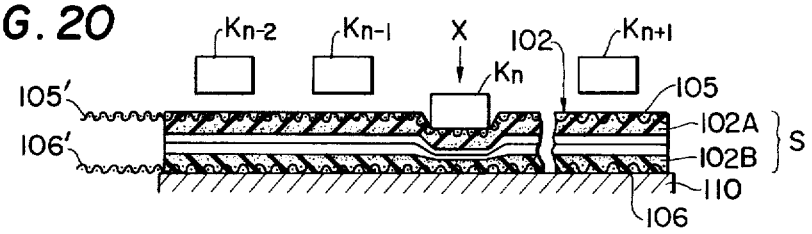
FIG. 20 is a somewhat diagrammatic fragmentary sectional view of still another example of the after-control signal detecting sensor means according to the present invention, in which laminated halves, forming a pair, of an elastic conductive member each has a net-shaped resilient, tough electrode member embedded close to the outer surface in said member, and has a longitudinally extending recessed region formed along the central portion thereof, thus defining a longitudinal cavity at the interface of the laminated halves.
Figure 21:
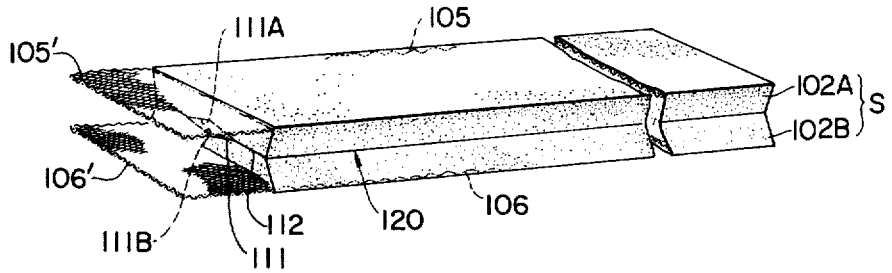
FIG. 21 is a perspective view of the aftercontrol signal detecting sensor means of FIG. 20.

FIG. 20 shows a still further modified example of the sensor means S according to the present invention.

Referring to FIG. 20, an after-control signal detecting sensor means S is provided at a predetermined distance below a row of keys in exactly the same manner as that of the preceding examples. In this example, however, the conductive elastic and flexible member 102 is composed of a pair of plate-like halves 102A and 102B which are superposed one upon another, as shown. A net-like output electrode member 105 is embedded in the upper portion of the upper half 102A of the conductive member 102 and a similar output electrode member 106 is embedded in the lower portion of the lower half 102B. Accordingly, a pair of output electrode members 105 and 106 sandwiches the conductive member 102 therebetween.

The material with which this conductive member 102 is made and the manner in which it contains the electrode members may be the same as that described in the preceding example.

Figure 18:
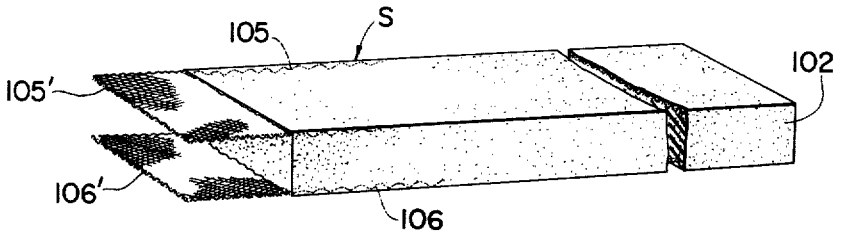
FIG. 18 is a perspective view of the aftercontrol signal detecting sensor means of FIG. 17.

The terminal structure of this sensor means S is also the same as that of the example shown in FIG. 18. Also, this conductive elastic member 102 is supported by a fixed plate in the manner same as that in the preceding example.

However, it will be noteworthy that a longitudinally extending cavity 111 is formed in, for example, the central portion of the boundary between the two halves 102A and 102B. Also, a contact portion 112 of the lower face of the upper half 102A and the upper face of the lower half 102B is formed at sites excluding the location of the cavity 111.

In this example, the cavity 111 is defined by two V-shaped grooves 111A and 111B formed in the abutting surfaces of the two halves 102A and 102B, jointly forming a cavity of a diamond shape cross section.

With the foregoing arrangement, when a key $K_n$ is depressed, a separately provided key switch not shown will close so that s sound having a pitch corresponding to this depressed key is generated.

Figure 22A:
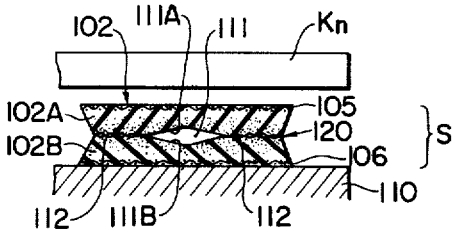
FIGS. 22A, 22B and 22C are somewhat diagrammatic fragmentary sectional views, showing the variations of the configuration of the sensor means of FIG. 20, depending on the position of the corresponding key.

At this moment, however, no pressure is applied yet to the conductive elastic member 102, so that the cavity 111 does not undergo any deformation as shown in FIG. 22A. Accordingly, the resistance value between the two electrode members 105 and 106 is determined by the natural resistance of the material of the conducting elastic member 102 and by the resistance value per unit area at the contact portion 112 of the two halves 102A and 102B. It should be understood that the contact surfaces of the halves 102A and 102B are not mirror surfaces, but they are comprised of coarse surfaces having uneven fine ridges and recesses. Accordingly, microscopically speaking, the contact portion 112 includes sites at which the two halves 102A and 102B contact each other and sites at which they are not in contact with each other via a very thin layer of air. These two kinds of portions are distributed in random fashion. As such, the contact portion 112 has a considerably great resistance value per unit area.

Figure 22B:
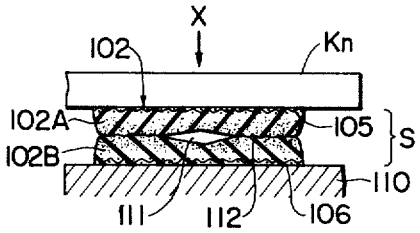

Let us now suppose that from the aforesaid state the key $K_n$ is depressed with a relatively great force as shown by the arrow X. Whereupon, the cavity 111 positioned immediately below the key $K_n$ does not undergo a deformation as shown in FIG. 22B, but the fine uneven surfaces of the two halves of the contact portion 112 are compressed toward each other to be deformed. As a result, the contacting surfaces of these two halves 102A and 102B will increase in the area of contact, or in other words, the regions sandwiching the layers of air will become decreased. Accordingly, the resistance value per unit area of the contact portion 112 just below the key $K_n$ will suddenly become small.

Figure 22C:
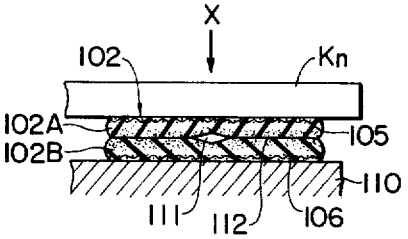
Figure 24A:
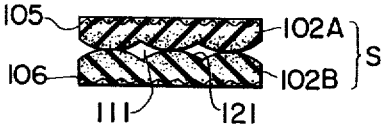
FIGS. 24A and 24B are somewhat diagrammatic fragmentary sectional views of modified examples of the after-control signal detecting sensor means of FIG. 20.
Figure 24B:
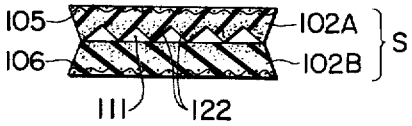

From this state, the key $K_n$ is depressed further deeply. Whereupon, the cavity 111 will be compressed and deformed as shown in FIG. 22C. Whereby, the area of contact of the contact portion 112 just below the key $K_n$ will increase for the amount corresponding to the amount of deformation sustained by said cavity 111. In proportion thereto, the resistance value between the electrode members 105 and 106 will suddenly become small. The bilateral sides of the conductive elastic member 102 are formed to have recesses 120 in order to facilitate the smooth escape of warping due to the deformation of the cavity 111.

In addition to what has been stated above, when the key $K_n$ is depressed further deeply after it has been brought into contact with the sensor means 2, the conductive elastic member 102 is compressed by this depressing force and its resistance becomes small and at the same time the distance between the two electrode members 105 and 106 decreases. Accordingly, the resistance value of that portion of the conductive member 102 located just below this key will be varied substantially successively in accordance with the magnitude of the depressing force applied to the key.

Figure 23:
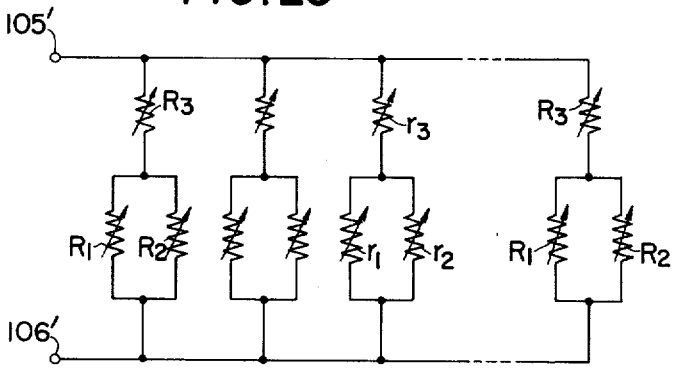
FIG. 23 is a schematic equivalent electric circuit diagram of the after-control signal detecting sensor means of FIG. 20.

As such, the equivalent circuit of the sensor means S will be expressed by the following arrangement shown in FIG. 23. That is, the equivalent circuit comprised, for each key, a parallel circuit consisting of a first variable resistance $R_1$ corresponding to the resistance variation of the contact portion 112 between the two halves 102A and 102B of the conductive member 102 and a second variable resistance $R_2$ corresponding to the resistance variation due to the variation in the area of contact at the cavity region 111 of the conductive member 102; a third resistance $R_3$ corresponding to the resistance variation of the conductive member 102 itself which is serially connected to said parallel circuit; and a plurality of such serial circuits are parallelly connected between the two output terminals 105' and 106'. As will be understood clearly from this equivalent circuit diagram, the synthesized resistance between these output terminals 105' and 106' of the sensor means S will vary depending on the amount of depression of each key.

Accordingly to this example, it is possible to obtain an after-control signal which is unfailingly responsive to the key operations. In particular, due to the arrangement of the conductive member 102 featuring the divided two halves which are in contact with each other and also featuring the provision of a cavity 111 at the interstice of these two halves, it is possible to obtain an after-control signal having variations of large amplitude, i.e. large dynamic range. More specifically, the dynamic range of the after-control signal is markedly increased in this example as compared with an instance wherein the resistances $R_1$ and $R_2$ shown in FIG. 23 are omitted.

Description has been made with respect to the instance wherein the cavity is of a diamond shape. However, the shape of the cavity is not limited thereto, and various other shapes may be considered such as those in FIG. 24A and FIG. 24B, with no practical change in the effect obtained.

The output electrode members 105 and 106 used in this example are made of net-like material which are embedded in the conductive member 102. However, the upper electrode member 105 may be replaced by, for example, a conductive rubber piece which is bonded to the upper surface of the conductive member 102 by a conductive adhesive. The lower electrode member 106 may be replaced by, for example, a rigid conductive metal plate which is held into contact with or bonded to the lower surface of the conductive member 102. Anyhow, these electrode members are required to be placed at opposing positions to sandwich the conductive member therebetween. Other manners of arrangement of the sensor means S may follow the way that has been described with respect to the preceding example.

Figure 25:
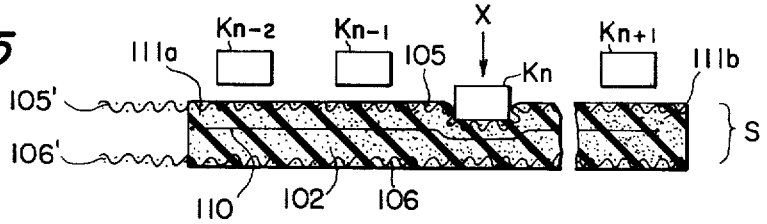
FIG. 25 is a somewhat diagrammatic fragmentary sectional view of a further modified example of the after-control signal detecting sensor means according to the present invention, in which the elastic conductive member has a pair of net-shaped electrode members embedded on opposite ends of said conductive member having a longitudinally extending flat cut formed through the central portion thereof.
Figure 26:
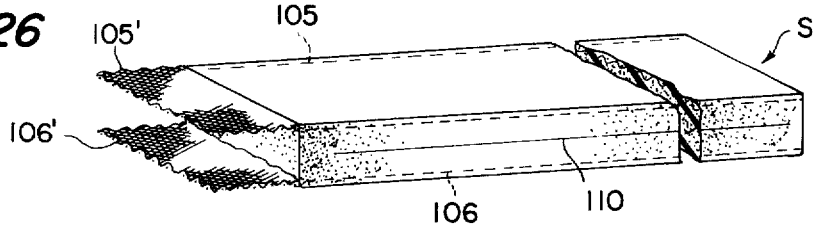
FIG. 26 is a somewhat diagrammatic perspective view of the after-control signal detecting sensor means of FIG. 25.

FIG. 25 shows a yet further modified example of the after-control signal detecting sensor means S according to the present invention. The general arrangement is similar to that shown in FIG. 17 expect for a cut 110 formed within the conductive elastic member 102 to extend in the direction of the row of keys in parallel therewith. This cut 110 passes transversely of the conductive elastic member 102 between the two electrode members 105 and 106 expecting the longitudinal end portions 111*a* and 111*b* of the conductive member 102. The upper and the lower wall surfaces of this cut 110 formed in the conductive member 102 serve to function in the similar way as that described with respect to the interstices of the two halves of the conducting member 102 of FIG. 20. The performance of the sensor means S, therefore, is similar to that of the example of FIG. 20, with the exception of the cavity portion of this latter example.

Figure 27:
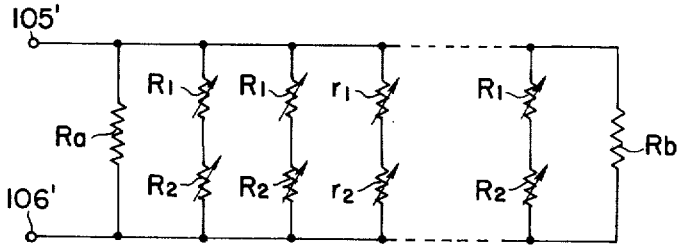
FIG. 27 is a schematic equivalent electric circuit diagram of the after-control signal detecting sensor means of FIG. 25.

The equivalent circuit of this instant example is expressed in FIG. 27. It composes an arrangement that for each key a serial circuit consisting of a first variable resistance $R_1$ corresponding to the resistance variation of the cut 110 and a second variable resistance $R_2$ corresponding to the resistance variation of the conductive member 102 itself is parallelly connected between the two output terminals 105' and 106'. In this equivalent circuit shown in FIG. 27, the fixed resistances Ra and Rb which are parallel with said serial circuit correspond to the resistance value between the two electrode members 105 and 106 at the opposite terminal portions. As will be clear from this Figure, the synthesized resistance between the two output terminals 105' and 106' will vary in accordance with the amount of depression of each key. Other manners of arrangement of this example may be apparent from the preceding examples.

Figure 28A:
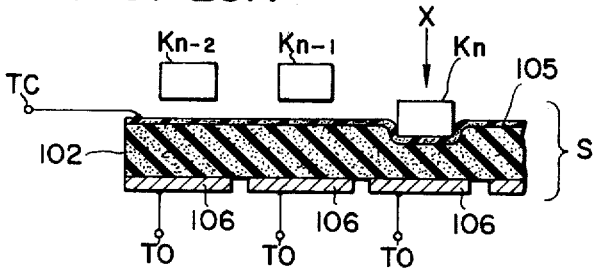
FIG. 28A is a somewhat diagrammatic fragmentary sectional view of a further modified example of the after-control signal detecting sensor means according to the present invention.
Figure 29A:
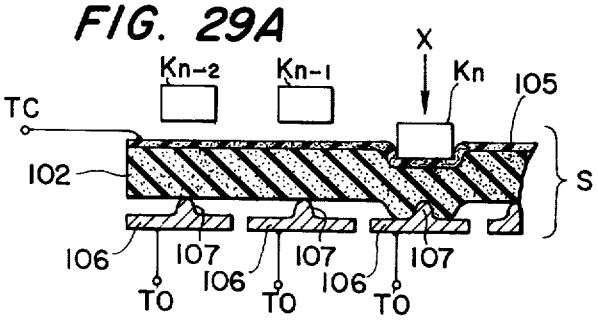
FIG. 29A and FIG. 30A are somewhat diagrammatic fragmentary sectional views of still further modified examples of the after-control signal detecting sensor means according to the present invention.
Figure 30A:
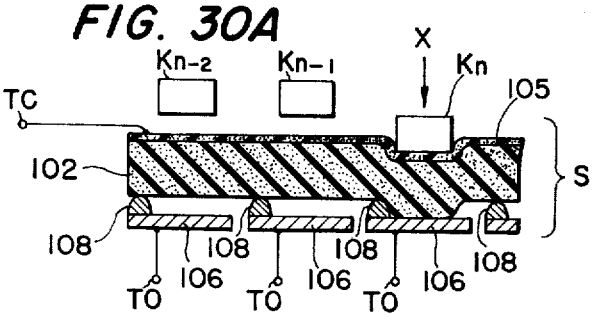
Figure 30B:
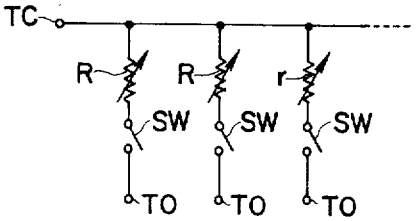

FIGS. 28A, 29A and 30A show further modified examples of the after-control signal detecting sensor means S according to the present invention.

Figure 28B:
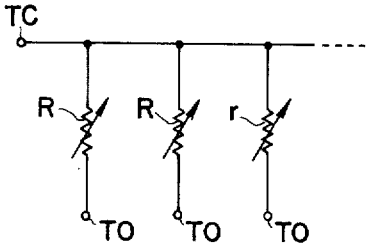
FIG. 28B is a schematic equivalent electric circuit diagram of the after-control signal detecting sensor means of FIG. 28A.

In the example shown in FIG. 28A, the sensor means S is provided at a predetermined distance below a row of keys to correspond to this row. The sensor means S comprises a conductive flexible and elastic member 102 extending in the transverse direction of keys and being provided, at its upper surface, with, for example, a conductive rubber which, serving as an elastic common electrode member 105, is firmly bonded to said upper surface of the conductive member 102 by a conductive adhesive. On the bottom surface of this conductive member 102 at such portions as are corresponding to the respective keys are provided rigid output electrode plates 106 which are firmly bonded to the conductive elastic member 102 by a conductive bonding agent. Though not shown, these electrode plates 106 are supported at their bottoms by an insulating fixed plate. The individual rigid electrode plates 106 are connected to output terminals 106, respectively. Accordingly, the variations of resistance caused by the depression of keys are obtained for each operation of keys. As such, the equivalent circuit of the sensor means S of FIG. 28A will be as shown in FIG. 28B.

FIG. 29A shows a further modified example of FIG. 28A, which is similar to the arrangement of FIG. 28A except that each of the output electrode members 106 has, at about the central portion of its upper surface, a semi-circular protrusion 107 whose tip is in point contact with the lower face of the conductive member 102.

Figure 29B:
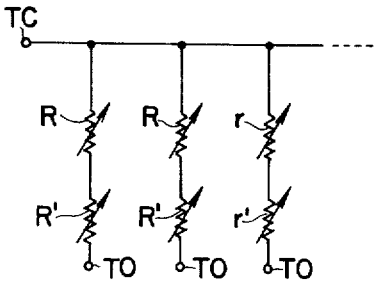
FIG. 29B and 30B are schematic equivalent electric circuit diagrams of the after-control signal detecting sensor means of FIG. 29A and FIG. 30A, respectively.

When a key $K_n$ is depressed deeply, the conductive member 102 is compressed so that the area of contact between the lower surface of the conductive member 102 and the protrusion 107 will vary in accordance with the position to which the key is depressed. Accordingly, this sensor means S will have the equivalent circuit as shown in FIG. 29B in which the variable resistance R corresponding to the degree of compression of the conductive member 102 is serially connected to a variable resistance R' which corresponds to the variation of contact resistance. Thus, a plurality of aftercontrol signals which produce further subtle variations as compared with the arrangement of FIG. 28B can be obtained.

FIG. 30A shows a still further modified example, in which the output terminals 106 each is provided with, for example, a semi-circular protrusion 108 at one upper end portion thereof as shown. The equivalent circuit is similar to that of FIG. 28B except for the provision of switches SW connected in series with the variable resistances R to function so that they will become "off" during the period until the conductive member 102 is brought into contact with the electrode member 106. According to this example, the timing of delivery of the after-control signal can be controlled by the depressing operation of keys.

In these three examples, the shape of the protrusion is not limited to semi-circular shape, but a triangular, a spherical or like configurations may also be employed.

The sensor means S in all of the examples described in this specification have been mentioned with respect to their arrangement wherein the keys are depressed downwardly. However, this arrangement may be modified to be operative so that the resistance value between the electrode members will be caused to vary by lateral shaking of keys also. For example, in the example shown in FIG. 29, the protrusion 107 may have such a shape that its surface will incline in either one side. With such an arrangement, it is possible to vary both the contact resistance between the conductive member 102 and the electrode member 105 and the resistance of the conductive member 102 itself.

The shape of the keys may be selected as desired. In addition to the flat-bottomed shape, they may have a bottom convex shape or a bottomconcave shape to suit the required after-control effects and the arrangement of the sensor means therefor.

A player may desire to play on an electronic musical instrument having a keyboard arrangement which will produce percussive sounds like a piano. In such an instance, the sensor means arrangement that the opposing electrodes which are normally kept in non-conducting state will be chosen. Also, a player who prefers a relatively heavy touch will choose an instrument whose sensor means is such that the resistance produced between the two electrode members is relatively high. Conversely, a player who prefers a relatively light touch will choose an instrument arranged so that this resistance is relatively small.

We claim:

1. A keyboard arrangement in an electronic musical instrument, comprising:

a plurality of keys pivotably supported and arranged in juxtaposed relationship, said keys being manually movable toward and away from a sensor means, and an after-control signal detecting sensor means positioned at a distance from said keys and extending in transverse direction of the direction of movement thereof keys to correspond to all of these keys, said sensor means comprising a flexible conductive pressure transmitting member serving as a first electrode member facing the bottoms of said keys at said distance therefrom, a conductive base member serving as a second electrode member, and a conductive flexible and elastic member extending below a number of said keys, with said first and second electrode members embedded therein at positions close to opposite surfaces of said elastic member, said conductive flexible and elastic member being made of a flexible and elastic material containing conductive particles dispersed therein and exhibiting a difference in electrical resistance between the state in which this member is compressed and deformed and the state in which it is not compressed and deformed, said first electrode member being adapted to flex itself when pressed by at least one of said keys to transmit to the conductive flexible and elastic member the pressures received from said at least one key of the keyboard to cause compression and deformation of the conductive flexible and elastic member in proportion to the magnitude and amount of said pressure thereby varying its resistance, said two electrode members being connected to input terminals of an electric circuitry of said instrument to input said varying resistance as an after-control signal.

2. A keyboard arrangement according to claim 1, in which said first electrode member is made with woven tinplated copper wire, and said conductive flexible and elastic member is made from foamed conductive rubber, and said second electrode member is made with woven flexible tin-plated copper wire.

3. A keyboard arrangement according to claim 1, in which said first and second electrode members are made of flexible woven copper wires.

4. A keyboard arrangement according to claim 1, in which said conductive flexible and elastic member consists of abuttingly superposed two halves of the same material each having a longitudinally extending recess formed on the abutting surface so as to provide a longitudinally extending cavity by the two recesses in the abutting positions of the two halves, and the abutting surfaces other than the areas where this cavity portion is formed are in contact with each other, and these two halves each has an inclined wall formed on the opposite lateral sides so as to provide recessed lateral sides in the abuttingly superposed positions of these halves.

5. A keyboard arrangement according to claim 1, in which said conductive flexible and elastic member has a cut formed therein traversing up to the opposite lateral sides excepting the opposing longitudinal end portions of said member.

6. A keyboard arrangement according to claim 1, in which said after-control signal detecting sensor means serving concurrently as a stopper for the keys.

7. A keyboard arrangement according to claim 3 in which said wires are tin-plated copper.

* * * * *